US010082147B2

(12) United States Patent
Jiang et al.

(10) Patent No.: US 10,082,147 B2
(45) Date of Patent: Sep. 25, 2018

(54) REGULATOR ASSEMBLY AND CENTRIFUGAL COMPRESSOR

(71) Applicant: GREE ELECTRIC APPLIANCES, INC. OF ZHUHAI, Zhuhai, Guangdong (CN)

(72) Inventors: Caiyun Jiang, Guangdong (CN); Zhiping Zhang, Guangdong (CN); Ruixing Zhong, Guangdong (CN); Nan Jiang, Guangdong (CN); Rong Xie, Guangdong (CN); Xiubing Yan, Guangdong (CN); Hongxing Wang, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 416 days.

(21) Appl. No.: 14/914,937

(22) PCT Filed: Aug. 14, 2014

(86) PCT No.: PCT/CN2014/084409
§ 371 (c)(1),
(2) Date: Feb. 26, 2016

(87) PCT Pub. No.: WO2015/027824
PCT Pub. Date: Mar. 5, 2015

(65) Prior Publication Data

US 2016/0208808 A1 Jul. 21, 2016

(30) Foreign Application Priority Data

Aug. 26, 2013 (CN) ..... 2013 1 0377440

(51) Int. Cl.
*F04D 29/46* (2006.01)
*F04D 27/00* (2006.01)
(Continued)

(52) U.S. Cl.
CPC ..... *F04D 27/002* (2013.01); *F04D 17/10* (2013.01); *F04D 27/0253* (2013.01);
(Continued)

(58) Field of Classification Search
CPC ..... F01D 11/005; F01D 5/02; F01D 11/001; F02C 7/04; F02C 7/28; F16J 15/04;
(Continued)

(56) References Cited

U.S. PATENT DOCUMENTS 2,382,913 A * 8/1945 Robinson ..... F04D 29/287 415/148
2,933,237 A * 4/1960 Darrow ..... F04D 29/464 415/146
(Continued)

FOREIGN PATENT DOCUMENTS

CN 101173683 A 5/2008
CN 203488437 U 3/2014
(Continued)

OTHER PUBLICATIONS

Patent Cooperation Treaty: International Search Report of PCT/CN2014/084409; Xu, Changhong; dated Nov. 17, 2014; 4 pages.

*Primary Examiner* — Logan Kraft
*Assistant Examiner* — Brian Delrue
(74) *Attorney, Agent, or Firm* — Gregory M. Howison

(57) ABSTRACT

A regulator assembly, comprising a vaned diffuser, a motor, a driving gear engaged with a driven gear, the driven gear having rectangle-shaped through holes thereon, the rectangle-shaped through holes disposed and extending along an axis of the driven gear, and a regulating mechanism including a regulator, a supporting member, wherein the regulator is sleeved on the supporting member, and wherein the vaned diffuser is fixed on the supporting member, and regulator sliding members fixed to the regulator through the rectangle-
(Continued)

shaped through holes of the driven gear, whereby the motor is configured to drive the driving gear to rotate, the driving gear is configured to drive the driven gear to rotate, the driven gear is configured to push the regulator sliding members to move, and the regulator sliding members are configured to drive the regulator to rotate relative to the vaned diffuser, thus driving the regulator to move along its axis.

20 Claims, 4 Drawing Sheets

(51) Int. Cl.

| | |
|---|---|
| ***F04D 17/10*** | (2006.01) |
| ***F04D 29/28*** | (2006.01) |
| ***F04D 29/44*** | (2006.01) |
| ***F04D 27/02*** | (2006.01) |
| *F25B 1/053* | (2006.01) |

(52) U.S. Cl.
CPC ..... *F04D 29/284* (2013.01); *F04D 29/444* (2013.01); *F04D 29/462* (2013.01); *F04D 29/464* (2013.01); *F05D 2250/52* (2013.01); *F25B 1/053* (2013.01)

(58) Field of Classification Search
CPC ..... F05D 2220/32; F05D 2220/36; F05D 2240/24; F05D 2240/55
USPC ..... 416/245 R
See application file for complete search history.

(56) References Cited

U.S. PATENT DOCUMENTS 2,996,996 A * 8/1961 Jassniker ..... F01D 17/143 415/126
3,032,259 A * 5/1962 Jassniker ..... F01D 17/143 415/148
3,160,392 A * 12/1964 Hunter ..... F01D 17/143 415/151
3,236,500 A * 2/1966 Kofink ..... F01D 17/143 415/150
3,243,159 A * 3/1966 Hefler ..... F01D 17/165 415/148
3,289,919 A * 12/1966 Wood ..... F01D 17/143 415/150
3,362,624 A * 1/1968 Endress ..... F04D 27/0215 415/1
3,365,120 A * 1/1968 Jassniker ..... F01D 17/143 415/126
3,426,964 A * 2/1969 Silvern ..... F01D 17/143 415/146
3,478,955 A * 11/1969 Kunderman ..... F01D 17/143 415/158
3,619,078 A * 11/1971 Mount ..... F04D 29/464 415/110
3,667,860 A * 6/1972 Endress et al. ..... F04D 29/462 415/149.1
3,784,318 A * 1/1974 Davis ..... F04D 15/0038 415/158
4,219,305 A * 8/1980 Mount ..... F01D 17/143 415/13
4,257,733 A * 3/1981 Bandukwalla ..... F04D 29/464 415/13
4,378,194 A * 3/1983 Bandukwalla ..... F01D 17/143 415/146
4,416,583 A * 11/1983 Byrns ..... F04D 29/464 415/148
4,460,310 A * 7/1984 Plunkett ..... F01D 17/143 415/158
4,611,969 A * 9/1986 Zinsmeyer ..... F01D 17/143 415/1
4,629,396 A * 12/1986 Lorett ..... F01D 17/165 415/164
4,643,639 A * 2/1987 Caine ..... F04D 29/468 277/412
4,802,817 A * 2/1989 Tyler ..... F01D 17/143 415/157
4,844,690 A * 7/1989 Delaurier ..... F01D 17/143 415/148
4,902,200 A * 2/1990 Bandukwalla ..... F01D 17/143 415/148
4,932,835 A * 6/1990 Sorokes ..... F04D 29/462 415/150
4,969,798 A * 11/1990 Sakai ..... F04D 27/0246 415/150
5,059,091 A * 10/1991 Hatfield ..... F04D 27/0284 415/11
5,116,197 A * 5/1992 Snell ..... F04D 29/464 415/126
5,214,920 A * 6/1993 Leavesley ..... F01D 17/143 415/157
5,683,223 A * 11/1997 Harada ..... F04D 27/02 415/17
5,807,071 A * 9/1998 Brasz ..... F04D 27/0253 415/148
5,895,204 A * 4/1999 Sishtla ..... F04D 29/464 415/148
6,129,511 A * 10/2000 Salvage ..... F01D 17/02 415/1
6,506,011 B1 * 1/2003 Sishtla ..... F04D 29/462 415/1
6,672,826 B2 * 1/2004 LeDuc ..... F04D 27/0215 415/159
6,810,666 B2 * 11/2004 Lutz ..... F01D 17/167 415/158
7,326,027 B1 * 2/2008 Skoch ..... F04D 27/0207 415/150
7,824,148 B2 * 11/2010 Tetu ..... F04D 27/0246 415/1
7,905,102 B2 * 3/2011 Bodell, II ..... F04D 27/0207 415/119
8,689,552 B2 * 4/2014 Iwata ..... F04D 29/462 415/26
8,863,513 B2 * 10/2014 Tabata ..... F04D 27/002 415/148

FOREIGN PATENT DOCUMENTS

DE 102008059462 A1 6/2009
JP 58594 B2 1/1983
KR 20120063089 A 6/2012

* cited by examiner

REGULATOR ASSEMBLY AND CENTRIFUGAL COMPRESSOR

CROSS-REFERENCE TO RELATED APPLICATIONS

This application is a U.S. National Phase application submitted under 35 U.S.C. § 371 of Patent Cooperation Treaty application serial no. PCT/CN2014/084409, filed Aug. 14, 2014, and entitled REGULATOR STRUCTURE AND CENTRIFUGAL COMPRESSOR, which application claims priority to Chinese patent application serial no. 201310377440.4, filed Aug. 26, 2013, and entitled 调节器结构及离心式压缩机

Patent Cooperation Treaty application serial no. PCT/CN2014/084409, published as WO2015/027824, and CN patent application serial no. 201310377440.4, are incorporated herein by reference.

TECHNICAL FIELD

The present disclosure relates to a regulator assembly, more particularly, to a regulator assembly for regulating the outlet width of the impeller of a centrifugal compressor, and to a centrifugal compressor.

BACKGROUND

In a centrifugal compressor of the prior art, the regulator is installed at the outlet of the impeller, forming a segment with an adjustable width. The outlet width of the impeller is regulated according to the operating conditions of the unit, so as to enable the unit to remain at the highest operating efficiency in a wider range. In the prior art, the regulator of the centrifugal compressor is normally linked with the regulating mechanism of the impeller. The regulator is not independent in structure, and thus the control is not precise enough. What is more, the regulating range of the adjustable width of the impeller is relatively smaller, and the regulator of the centrifugal compressor is not applicable to compressors under various kinds of operating conditions.

In view of the defects above, after long time of research and practice, the inventors finally obtained the present invention.

SUMMARY

In view of the situations, it is imperative to provide a regulator assembly capable of realizing a larger regulating range, and to provide a centrifugal compressor.

The present disclosure provides a regulator assembly, comprising a vaned diffuser, wherein, said regulator assembly further comprises a motor, a driving gear, a driven gear and a regulating mechanism;

the motor is rotatable forwardly and reversibly; the driving gear is engaged with the driven gear;

the regulating mechanism comprises a regulator, a supporting member and regulator sliding members;

the driven gear is sleeved on the regulator; the regulator is sleeved on the supporting member;

the driven gear has rectangle-shaped through holes thereon, the rectangle-shaped through holes are disposed and extend along an axis of the driven gear;

the regulator sliding members are fixed to the regulator through the rectangle-shaped through holes;

the vaned diffuser is fixed on the casing, and is provided with internal threads;

the regulator is provided with external threads, the external threads are engageable with the internal threads of the vaned diffuser;

the motor is configured to drive the driving gear to rotate; the driving gear is configured to drive the driven gear to rotate; the driven gear is configured to push the regulator sliding members to move; and the regulator sliding members are configured to drive the regulator to rotate relative to the vaned diffuser, thus driving the regulator to move along its axis. In some embodiments, the regulator assembly further comprises a driven gear stopper;

the driven gear stopper is sleeved on the regulator, and is disposed between the driven gear and the vaned diffuser.

In some embodiments, a bearing is disposed between the driven gear and the driven gear stopper.

In some embodiments, grooves, which match with the rectangle-shaped through holes, are disposed on a periphery of the regulator; an axis of each groove is perpendicular to the axis of the driven gear;

Each regulator sliding member is fixed in corresponding groove through corresponding rectangle-shaped through hole.

In some embodiments, at least two rectangle-shaped through holes are arranged evenly along a circumference of the driven gear;

the number of the grooves is identical to the number of the rectangle-shaped through holes.

In some embodiments, the groove is provided with internal threads;

the regulator sliding member is a bolt; the internal threads of the groove are engaged with and fixed with external threads of the regulator sliding member.

In some embodiments, a sealing groove is disposed in a periphery of the supporting member; a sealing ring is disposed in the sealing groove.

In some embodiments, length of the regulator is greater than length of the supporting member.

A refrigeration compressor of the present disclosure comprises an impeller and the regulator assembly mentioned above.

In some embodiments, an end of the regulator with external threads thereon is arranged near an outlet of the impeller;

when the motor drives the driving gear to rotate forwardly, the driving gear drives the driven gear to rotate forwardly, and the end of the regulator with external threads thereon is retracted continuously, until the outlet of the impeller is opened completely; when the motor drives the driving gear to rotate reversibly, the driving gear drives the driven gear to rotate reversibly, and the end of the regulator with external threads thereon extends continuously, until the outlet of the impeller is closed completely.

As compared with the prior art, the present disclosure has the beneficial effects as follows: the regulator assembly and the centrifugal compressor can realize a larger regulating range and have a wider range of applications; the outlet can be sealed completely, which prevents the refrigerant from flowing backwards to drive the impeller to rotate reversely, thereby avoiding the damage to the impeller; the regulator assembly is controlled independently, fewer transmission mechanisms are required, thus the transmission efficiency and the reliability are higher; the air flow direction and air flow rate at the inlet of the vaned diffuser are maintained unchanged, which reduces impact losses and avoids surges effectively; the overall structure of the regulator assembly is compact, and the regulator assembly is convenient to process and produce, and is convenient to refit.

DETAILED DESCRIPTION

In order to solve the problem of the too small regulating range, a regulator assembly is provided.

The technical features above, additional technical features and the beneficial effects of the present invention will be described in more details with reference to the accompanying figures.

Figure 1:
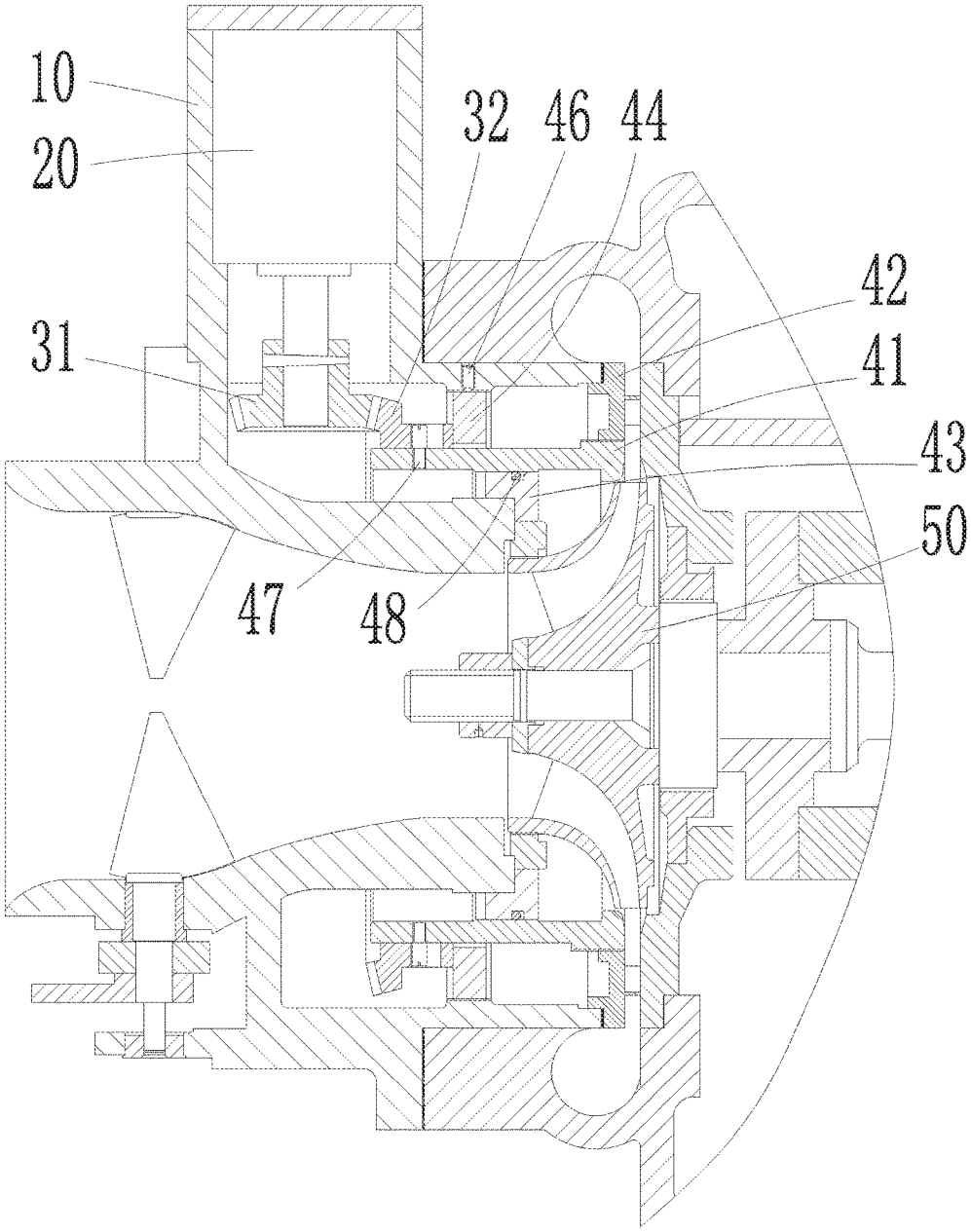
FIG. 1 is a schematic diagram illustrating the regulator assembly completely opened according to the first embodiment of the present invention.

FIG. 1 is a schematic diagram illustrating the regulator assembly completely opened according to the first embodiment of the present invention. As shown in FIG. 1, the regulator assembly comprises a motor 20, a driving gear 31, a driven gear 32, a vaned diffuser 42 and a regulating mechanism.

The motor 20 is rotatable forwardly and reversibly.

Preferably, the driving gear 31 and the driven gear 32 are bevel gears.

The driving gear 31 is connected with the motor 20, and the motor 20 drives the driving gear 31 to rotate. As the driving gear 31 is engaged with the driven gear 32, the driven gear 32 rotates synchronously.

The regulating mechanism comprises a regulator 41, a supporting member 43 and regulator sliding members 47.

The outer contour of the supporting member 43 is cylinder-shaped.

The regulator 41 is formed through rotation machining, and has a through hole in the center. The regulator 41 is sleeved on the outer contour of the supporting member 43. The length of the regulator 41 is greater than the length of the supporting member 43. The supporting member 43 is disposed at the intermediate part of the regulator 41, so that the regulator 41 can be supported more evenly.

The motor 20 drives the driving gear 31 to rotate, and the driving gear 31 drives the driven gear 32 to rotate. The driven gear 32 pushes the regulator sliding members 47 to move, and the regulator sliding members 47 drive the regulator 41 to rotate relative to the vaned diffuser 42, thus the regulator 41 moves along its axis.

The driven gear 32 is sleeved on the regulator 41, and the axis of the driven gear 32 is coincident with the axis of the regulator 41. The driven gear 32 has rectangle-shaped through holes thereon, and the axis of each rectangle-shaped through hole is perpendicular to the axis of the driven gear 32. The rectangle-shaped through hole extends along the axis of the driven gear 32. At least two rectangle-shaped through holes are arranged in the driven gear 32. In consideration of difficulties of the processing and balancing of forces acting on the driven gear, two rectangle-shaped through holes are preferably provided.

The regulator sliding members 47 are fixed to the regulator 41 through the rectangle-shaped through holes, and the regulator sliding member is fixed with the regulator 41 through welding or is integrally formed with the regulator 41.

Preferably, grooves are provided at the proximal end of the regulator 41, which is proximal to the driven gear 32. The number of the grooves is identical to the number of the rectangle-shaped through holes, and the positions of the grooves arranged on the circumference of the regulator 41 correspond with the positions of the rectangle-shaped through holes. The regulator sliding member 47 is connected to the groove through the rectangle-shaped through hole in the driven gear 32. This kind of structure is easy to process and the installation is fixed and stable.

The groove may be provided with threads, and the regulator sliding member 47 may be provided with threads as well, so that the regulator sliding member 47 is connected with the groove reliably through threads. The regulator sliding member 47 is a screw or a bolt. The regulator 41 and the regulator sliding member 47, as an integral assembly, move in the rectangle-shaped through hole in the axial direction of the regulator 41. The length of the rectangle-shaped through hole determines the displacement distance in the axial direction.

External threads are provided at the distal end of the regulator 41, which is distal from the driven gear 32. The vaned diffuser 42 is provided with internal threads. The vaned diffuser 42 is sleeved on the external threads of the regulator 41, and is connected with the regulator 41 through threads. Meanwhile, the vaned diffuser 42 is fixed on the casing 10.

According to the description above, when the driven gear 32 rotates to drive the regulator 41 to rotate, the regulator 41 threadably engages with the vaned diffuser 42, and the vaned diffuser 42 is positioned and fixed, and thus the rotation of the regulator 41 will make itself to move in the axial direction, and the regulator 41 is pushed forwards along the axial direction through the internal threads of the vaned diffuser 42. When the motor 20 rotates reversibly, the motor drives the driving gear 31, the driven gear 32 and the regulator 41 to rotate reversibly, and the regulator 41 moves backwards along the axial direction through the internal threads of the vaned diffuser 42.

The length of the external threads of the regulator 41 is designed according to actual requirements, and the length of the corresponding rectangle-shaped through hole in the driven gear 32 is adjusted accordingly, thereby realizing a wider regulating range and meeting different requirements under practical conditions.

Preferably, in order to prevent the driven gear 32 from moving in the axial direction and ensure that the driven gear 32 is engaged with the driving gear 31, a driven gear stopper 44 is arranged on the regulator 41. The driven gear stopper 44 has a through hole in the center and is sleeved on the regulator 41.

Preferably, the regulating mechanism further comprises a position-limiting fastener 46, which fixes the driven gear stopper 44 on the case 10.

The position-limiting fastener 46 may be a bolt, a positioning pin or a key in structure. Multiple position-limiting fasteners 46 may be arranged along the periphery of the driven gear stopper 44.

Preferably, a sealing groove is provided in a periphery of the supporting member 43 to contain a sealing ring 48, which ensures a good sealing between the regulator 41 and the supporting member 43.

The regulator assembly is installed on the centrifugal compressor. The centrifugal compressor comprises a case 10. The supporting member 43 is fixed on the case 10. The end of the regulator 41 with external threads thereon is disposed near the outlet of the impeller 50. The axial movement of the regulator 41 causes the expansion and contraction of the regulator 41, thereby changing the outlet width of the impeller 50.

When the motor 20 drives the driving gear 31 to rotate forwardly, the driving gear 31 drives the driven gear 32 to rotate forwardly, and the end of the regulator 41 with external threads thereon is retracted continuously, until the outlet of the impeller 50 is opened completely. The state of the impeller 50 with the largest outlet width is shown in FIG. 1.

Figure 2:
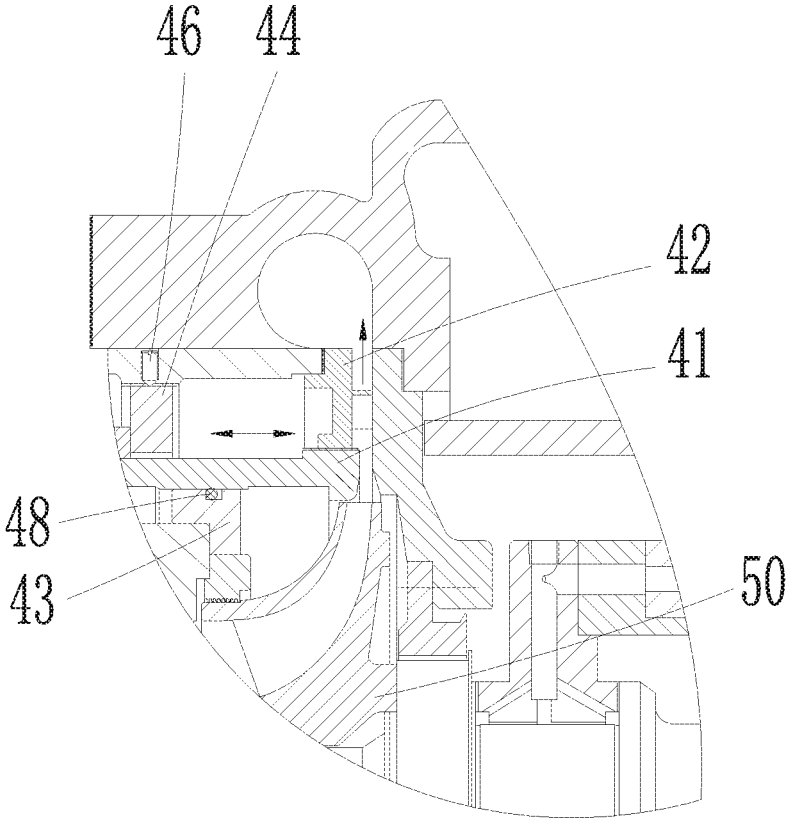
FIG. 2 is a partial schematic diagram illustrating the regulator assembly incompletely opened according to the first embodiment of the present invention.

FIG. 2 is a partial schematic diagram illustrating the regulator assembly incompletely opened according to the first embodiment of the present invention. As shown in FIG. 2, the regulator 41 of the regulator assembly is in a state of being incompletely opened. As shown in the figure, the directions denoted by the double-headed arrow are the directions in which the regulator 41 moves along its axis; the direction denoted by the single-headed arrow is the direction in which the refrigerant in the centrifugal compressor flows.

Figure 3:
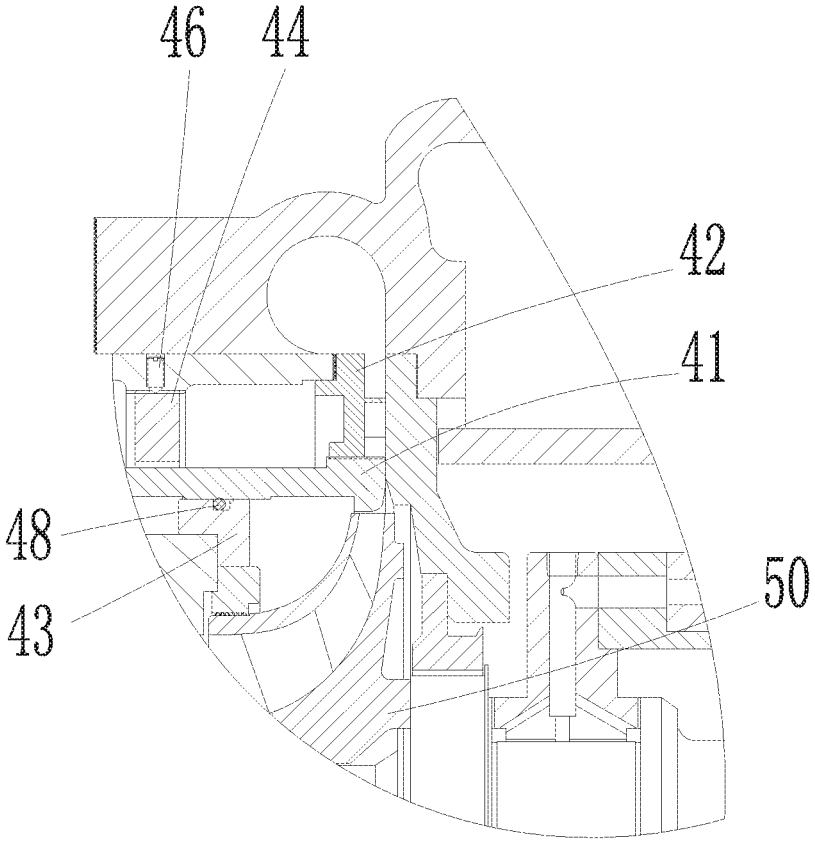
FIG. 3 is a partial schematic diagram illustrating the regulator assembly completely closed according to the first embodiment of the present invention.

FIG. 3 is a partial schematic diagram illustrating the regulator assembly completely closed according to the first embodiment of the present invention. When the motor 20 drives the driving gear 31 to rotate reversibly, the driving gear 31 drives the driven gear 32 to rotate reversibly, and the end of the regulator 41 with external threads thereon extends continuously, until the outlet of the impeller 50 is closed completely.

When the regulator 41 extends to the farthest position, the outlet of the impeller 50 is sealed completely, which prevents the refrigerant from flowing backwards to drive the impeller 50 to rotate reversely. The regulator assembly does not need to use a check valve, thereby preventing the impeller 50 from rotating reversely to cause damages.

Figure 4:
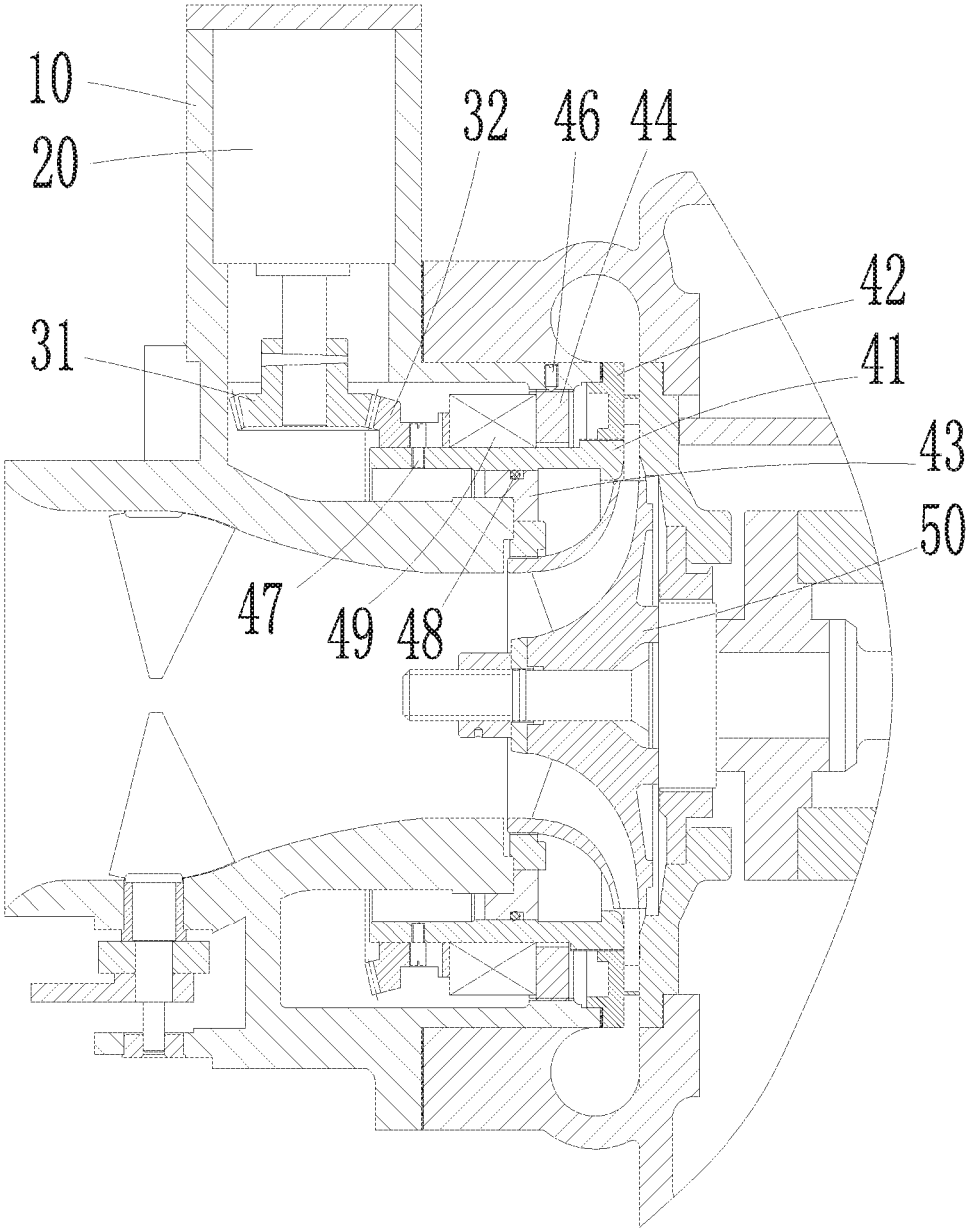
FIG. 4 is a schematic diagram illustrating the regulator assembly completely opened according to the second embodiment of the present invention.

FIG. 4 is a schematic diagram illustrating the regulator assembly completely opened according to the second embodiment of the present invention. The second embodiment differs from the first embodiment shown in FIG. 1 in that: in the regulator assembly, a bearing 49 is provided between the driven gear 32 and the vaned diffuser 42.

Preferably, the bearing 49 is a thrust bearing. The frictional resistance of the thrust bearing is relatively smaller and the operating state of the thrust bearing is better.

Conventional centrifugal compressors are mature products which are mass-produced in series. The regulator assembly may be installed in the existing space of the conventional centrifugal compressor by slightly refitting the existing vaned diffuser and the existing case. By slightly changing the dimension of the regulator 41, the regulator 41 can be applied to impellers 50 with different diameters. The regulator assembly can be applied to centrifugal compressors with different powers, and has a wider range of applications.

The present disclosure can regulate the outlet width of the impellers 50 precisely according to the operating conditions of applications, so as to form continuous and regulable width, enabling the centrifugal compressor to operate at the highest efficiency.

The regulator assembly is controlled independently, fewer transmission mechanisms are required, and the transmission efficiency and the reliability are higher. Through regulating by the regulator assembly, it is ensured that the air flow direction and air flow rate at the inlet of the vaned diffuser 42 are maintained unchanged, which reduces impact losses and avoids surges effectively. The regulator assembly has high reliability, and the centrifugal compressor has a wider operating range. The overall structure of the regulator assembly is compact, and the regulator assembly is convenient to process and produce.

Described above are several embodiments of the present invention, and they are specific and in details, but not intended to limit the scope of the present invention. It will be understood by those skilled in the art that various modifications and improvements can be made without departing from the concept of the present invention, and all these modifications and improvements are within the scope of the present invention.

What is claimed is:

1. A regulator assembly, comprising:

a vaned diffuser provided with internal threads;

a motor rotatable forwardly and reversibly;

a driving gear engaged with a driven gear;

the driven gear having rectangle-shaped through holes thereon, the rectangle-shaped through holes disposed and extending along an axis of the driven gear; and a regulating mechanism including:

a regulator provided with external threads, the external threads engagable with the internal threads of the vaned diffuser, wherein the driven gear is sleeved on the regulator;

a supporting member, wherein the regulator is sleeved on the supporting member, and wherein the vaned diffuser is fixed on a case; and regulator sliding members fixed to the regulator through the rectangle-shaped through holes of the driven gear;

whereby the motor is configured to drive the driving gear to rotate, the driving gear is configured to drive the driven gear to rotate, the driven gear is configured to push the regulator sliding members to move, and the regulator sliding members are configured to drive the regulator to rotate relative to the vaned diffuser, thus driving the regulator to move along its axis.

2. The regulator assembly according to claim 1, further comprising a driven gear stopper sleeved on the regulator and disposed between the driven gear and the vaned diffuser.

3. The regulator assembly of claim 2, wherein a bearing is disposed between the driven gear and the driven gear stopper.

4. The regulator assembly of claim 3, wherein a sealing groove is disposed in a periphery of the supporting member, and a sealing ring is disposed in the sealing groove.

5. The regulator assembly of claim 2, wherein a sealing groove is disposed in a periphery of the supporting member, and a sealing ring is disposed in the sealing groove.

6. The regulator assembly of claim 2, wherein grooves, which match with the rectangle-shaped through holes of the driven gear, are disposed on a periphery of the regulator, and an axis of each groove is perpendicular to the axis of the driven gear, each regulator sliding member fixed in a corresponding groove through a corresponding rectangle-shaped through hole.

7. The regulator assembly of claim 6, wherein at least two rectangle-shaped through holes are arranged evenly along a circumference of the driven gear, and the number of the grooves is identical to the number of the rectangle-shaped through holes.

8. The regulator assembly of claim 1, wherein grooves, which match with the rectangle-shaped through holes of the driven gear, are disposed on a periphery of the regulator, and an axis of each groove is perpendicular to the axis of the driven gear, each regulator sliding member fixed in a corresponding groove through a corresponding rectangle-shaped through hole.

9. The regulator assembly of claim 8, wherein at least two rectangle-shaped through holes are arranged evenly along a circumference of the driven gear, and the number of the grooves is identical to the number of the rectangle-shaped through holes.

10. The regulator assembly of claim 8, wherein the groove is provided with internal threads, the regulator sliding member is a bolt, and the internal threads of the groove are engaged with and fixed with external threads of the regulator sliding member.

11. The regulator assembly of claim 1, wherein a sealing groove is disposed in a periphery of the supporting member, and a sealing ring is disposed in the sealing groove.

12. The regulator assembly of claim 1, wherein the length of the regulator is greater than the length of the supporting member.

13. A refrigeration compressor, comprising:

an impeller;

a vaned diffuser provided with internal threads;

a motor rotatable forwardly and reversibly;

a driving gear engaged with a driven gear;

the driven gear having rectangle-shaped through holes thereon, the rectangle-shaped through holes disposed and extending along an axis of the driven gear; and a regulating mechanism including:

a regulator provided with external threads, the external threads engagable with the internal threads of the vaned diffuser, wherein the driven gear is sleeved on the regulator;

a supporting member, wherein the regulator is sleeved on the supporting member, and wherein the vaned diffuser is fixed on a casing; and regulator sliding members fixed to the regulator through the rectangle-shaped through holes of the driven gear;

whereby the motor is configured to drive the driving gear to rotate, the driving gear is configured to drive the driven gear to rotate, the driven gear is configured to push the regulator sliding members to move, and the regulator sliding members are configured to drive the regulator to rotate relative to the vaned diffuser, thus driving the regulator to move along its axis.

14. The refrigeration compressor of claim 13, wherein the regulator assembly further comprises a driven gear stopper sleeved on the regulator and disposed between the driven gear and the vaned diffuser.

15. The refrigeration compressor of claim 14, wherein a bearing is disposed between the driven gear and the driven gear stopper.

16. The refrigeration compressor of claim 13, wherein grooves, which match with the rectangle-shaped through holes, are disposed on a periphery of the regulator, an axis of each groove is perpendicular to the axis of the driven gear, and each regulator sliding member is fixed in a corresponding groove through a corresponding rectangle-shaped through hole.

17. The refrigeration compressor of claim 16, wherein at least two rectangle-shaped through holes are arranged evenly along a circumference of the driven gear, and the number of the grooves is identical to the number of the rectangle-shaped through holes.

18. The refrigeration compressor of claim 13, wherein an end of the regulator with external threads thereon is arranged near an outlet of the impeller, and when the motor drives the driving gear to rotate forwardly, the driving gear drives the driven gear to rotate forwardly, and the end of the regulator with external threads thereon is retracted continuously, until the outlet of the impeller is opened completely, and when the motor drives the driving gear to rotate reversibly, the driving gear drives the driven gear to rotate reversibly, and the end of the regulator with external threads thereon extends continuously, until the outlet of the impeller is closed completely.

19. The refrigeration compressor of claim 18, wherein the regulator assembly further comprises a driven gear stopper sleeved on the regulator and disposed between the driven gear and the vaned diffuser.

20. The refrigeration compressor of claim 19, wherein a bearing is disposed between the driven gear and the driven gear stopper.

* * * * *